US006896352B2

(12) United States Patent
Miyauchi

(10) Patent No.: US 6,896,352 B2
(45) Date of Patent: May 24, 2005

(54) INK JET RECORDING APPARATUS

(75) Inventor: Yasuo Miyauchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/615,987

(22) Filed: Jul. 10, 2003

(65) Prior Publication Data

US 2004/0027409 A1 Feb. 12, 2004

(30) Foreign Application Priority Data

Jul. 15, 2002 (JP) ..... 2002-205880

(51) Int. Cl.[7] ..... B41J 2/165
(52) U.S. Cl. ..... 347/30; 347/31
(58) Field of Search ..... 347/22, 24, 29, 347/30–33

(56) References Cited

U.S. PATENT DOCUMENTS 6,286,930 B1 * 9/2001 Kobayashi et al. ..... 347/29
6,629,749 B1 10/2003 Miyauchi et al. ..... 347/32
6,641,249 B1 11/2003 Miyauchi ..... 347/30

FOREIGN PATENT DOCUMENTS

JP 2002-103639 4/2002

* cited by examiner

*Primary Examiner*—Shih-Wen Hsieh
(74) *Attorney, Agent, or Firm*—Fitzpatrick, Cella, Harper & Scinto

(57) ABSTRACT

An ink jet recording apparatus, capable of preventing defective idle suction, comprises a cap movable toward/away from an ejection port surface of a recording head for capping/uncapping the ejection port surface, an absorbing member chamber opened to the ejection port surface, a suction port formed through the bottom of the absorbing member chamber, an ink suction device connected to the suction port, and an ink absorbing member disposed in the absorbing member chamber. In the apparatus, the absorbing member comprises a first absorbing portion covering approximately the entire region in the absorbing member chamber and a second absorbing portion in intimate contact with the suction port.

6 Claims, 10 Drawing Sheets

INK JET RECORDING APPARATUS

BACKGROUND OF THE INVENTION

1. Field of the Invention

The present invention relates to an ink jet recording apparatus for executing recording by ejecting ink onto a recording medium, and more particularly, to an arrangement of a recovery unit for protecting a recording means such as a recording head, and the like.

2. Related Background Art

Inkjet recording apparatuses eject ink onto a recording medium from nozzles disposed on a recording head. The tips of the nozzles are disposed on a flat surface called a nozzle surface. The nozzle surface of the recording head is covered by a cap of a recovery unit, whereby it is protected as well as prevented from being dried. The cap includes a suction port which is formed on the bottom thereof and communicates with a suction means such as a pump means and the like. By suctioning ink from the recording head the suction means prevents clogging due to dusts deposited on the nozzles and ink adhered thereto, and further overcomes a disadvantage and the like caused by bubbles. An absorbing member composed of a porous material is disposed in the cap, and when a pump suctions ink, the absorbing member suctions the ink deposited on the nozzle surface and prevents the ink from remaining on the nozzle surface. Without the absorbing member, when the cap is separated from the recording head after the ink has been suctioned, a large amount of ink remains on the nozzle surface and in the cap and is liable to scatter around the nozzle surface.

Further, when time elapses in a state in which a large amount of ink is deposited on the nozzle surface, there is a possibility that the ink in the vicinity of the nozzles enters the recording head through the nozzles, from which a problem of color mixture arises in ink jet recording apparatuses using a plurality of colors. As a result, colors are set erroneously, and it is difficult to execute proper recording.

To remove the remaining ink, it is also possible to wipe it. When, however, a large amount of ink remains, a large amount of ink is also removed by the wiping operation, which requires an additional means for holding the removed ink. Further, when the large amount of ink remains, there is a possibility that the ink scatters by the wiping operation. Therefore, the absorbing member in the cap is an effective means for minimizing the remaining ink.

A suction operation called idle suction may be executed to discharge the ink in the cap by the pump means. In this case, a relationship between the absorbing member and the suction port is important. That is, when the absorbing member securely comes into intimate contact with the suction port, the ink held by the absorbing member is discharged. However, when there is a gap between the absorbing member and the suction port, almost no suction force acts on the absorbing member, thereby so-called defective idle suction is executed.

When the defective idle suction is executed, since the ink remains held by the absorbing member, the absorbing member cannot exhibit a suction capability more effectively. Thus, the ink being held is stored in the vicinity of the nozzles, thereby there is a possibility that the problem of the ink mixture becomes more serious.

SUMMARY OF THE INVENTION

An object of the present invention is to provide an ink jet recording apparatus capable of preventing defective idle suction.

In the present invention, an ink jet recording apparatus for executing recording by ejecting ink from recording means to a recording medium comprises a cap movable in a direction where it comes into contact with and is separated from the ejection port surface of the recording means, for capping the ejection port surface, an absorbing member chamber disposed to the cap and opened in confrontation with the ejection port surface, a suction port formed through the bottom of the absorbing member chamber, a suction means connected to the suction port for suctioning the ink in the absorbing member chamber, and an absorbing member disposed in the absorbing member chamber for absorbing ink, wherein the absorbing member comprises a first absorbing portion covering approximately the entire region in the absorbing member chamber and a second absorbing portion in intimate contact with the suction port.

According to the present invention, there can be provided an ink jet recording apparatus capable of preventing defective idle suction.

DETAILED DESCRIPTION OF THE PREFERRED EMBODIMENTS

Next, preferable embodiments of an ink jet recording apparatus according to the present invention will be described based on the figures.

(First Embodiment)

Figure 9:
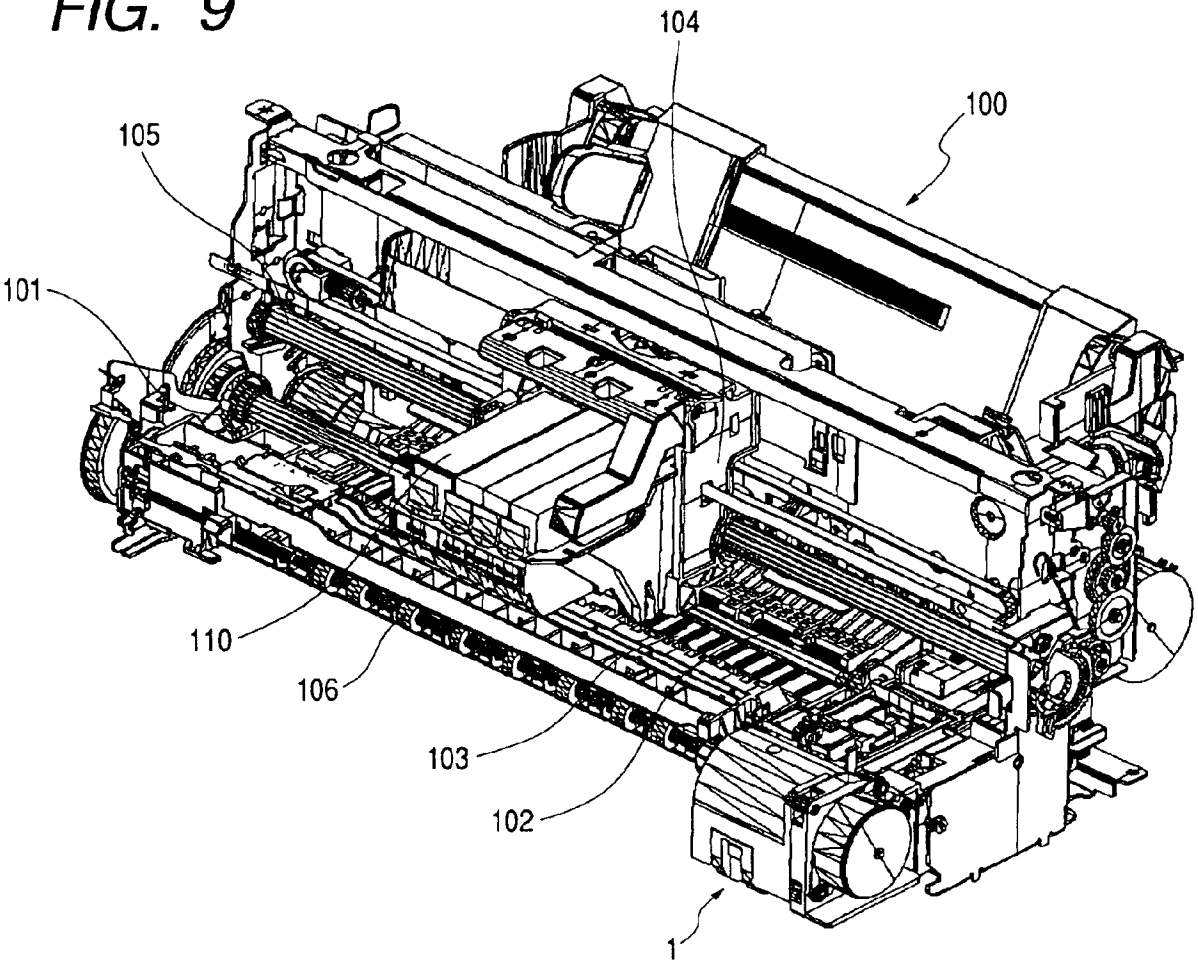
FIG. 9 is a perspective view showing an overall structure of the ink jet recording apparatus according to the present invention in the first embodiment.

The embodiments of the present invention will be described below with reference to the drawings. FIG. 9 is a perspective view showing an overall arrangement of an ink jet recording apparatus according to the present invention in a first embodiment, and FIG. 10 is a perspective view showing an outline of a nozzle surface in the first embodiment.

In FIG. 9, the ink jet recording apparatus feeds a recording medium such as a sheet and the like by a sheet feed means 100, and the recording medium is transported while being clamped between a transportation (or conveying) roller 101 and a pinch roller 102 and supplied onto a platen 103. A carriage 104, on which a recording head 110 is mounted, travels along a guide shaft 105 in confrontation with the recording medium on the platen 103 and records data for one line on the recording medium. Thereafter, the sheet is transported a predetermined amount by the transportation roller 101 and data is recorded on the entire region of the recording medium by repeating the recording operation and the transporting operation. On the completion of the recording operation, the recording medium is discharged to the outside of the apparatus by a sheet discharge roller 106.

Figure 10:
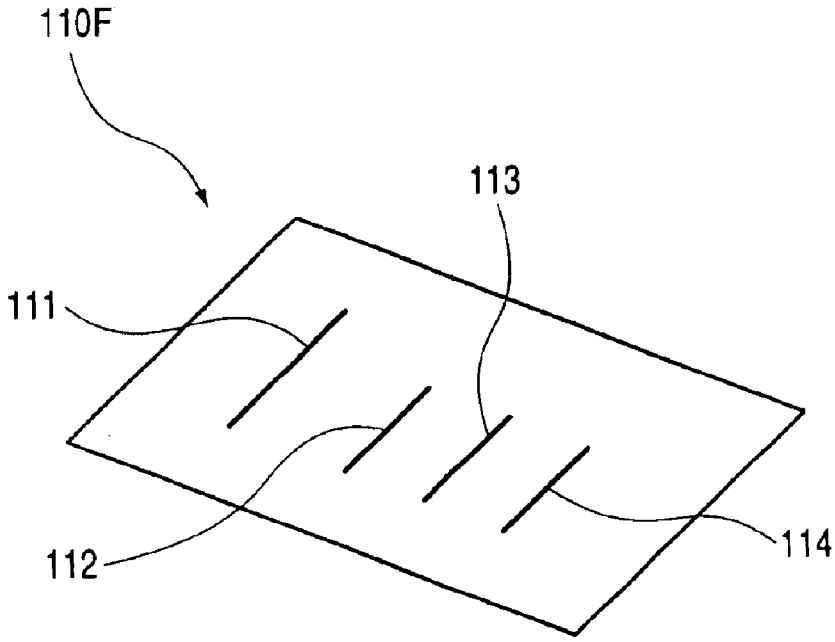
FIG. 10 is a perspective view showing an outline of a nozzle surface in the first embodiment.

In FIG. 10, the recording head 110 has a plurality of nozzles 111, 112, 113, and 114 that correspond to a plurality of colors, and the ejection ports of these nozzles are disposed on a nozzle surface 110F in parallel with each other in the traveling direction of the carriage 104. The nozzles 111, 112, 113, and 114 eject inks of four colors, i.e., black, cyan, magenta, and yellow, respectively. The ink jet recording apparatus is provided with a recovery unit 1 for keeping the recording head 110 in a good recording state.

Figure 1:
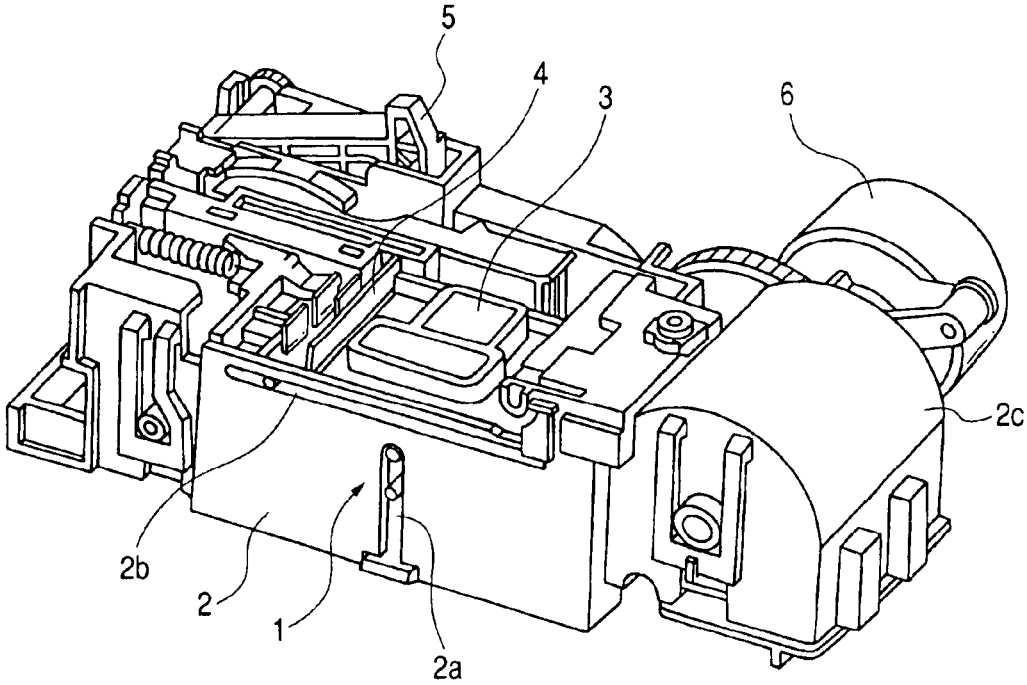
FIG. 1 is a perspective view showing a recovery unit in a first embodiment of an ink jet recording apparatus according to the present invention.
Figure 2:
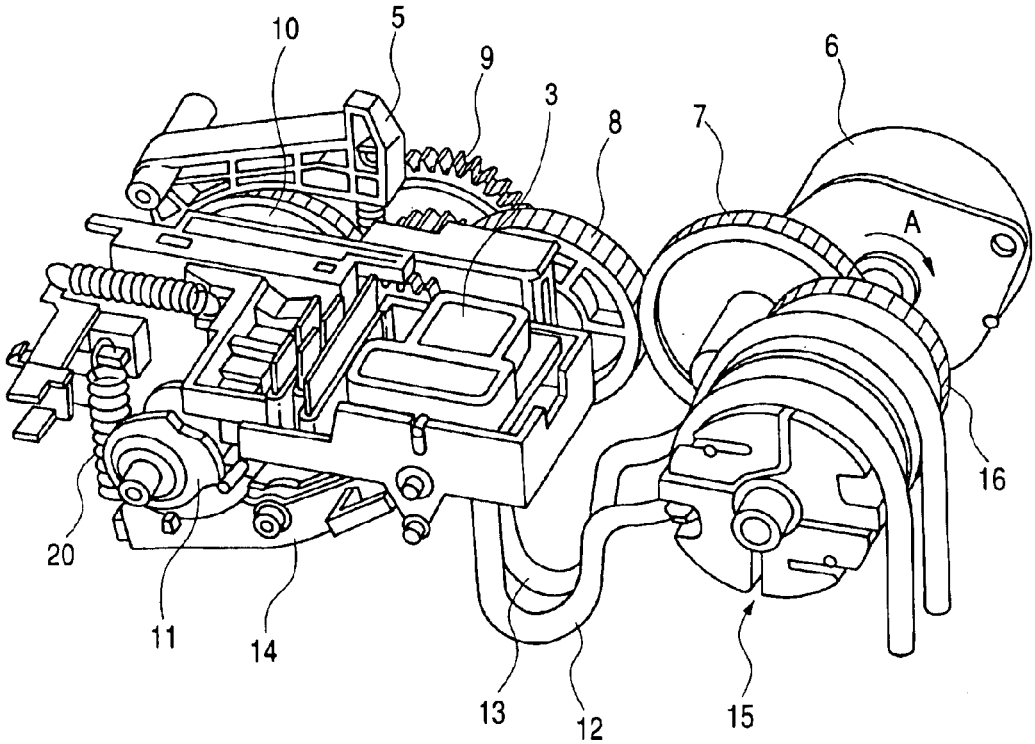
FIG. 2 is an internal perspective view showing an internal structure of the recovery unit of FIG. 1.
Figure 3:
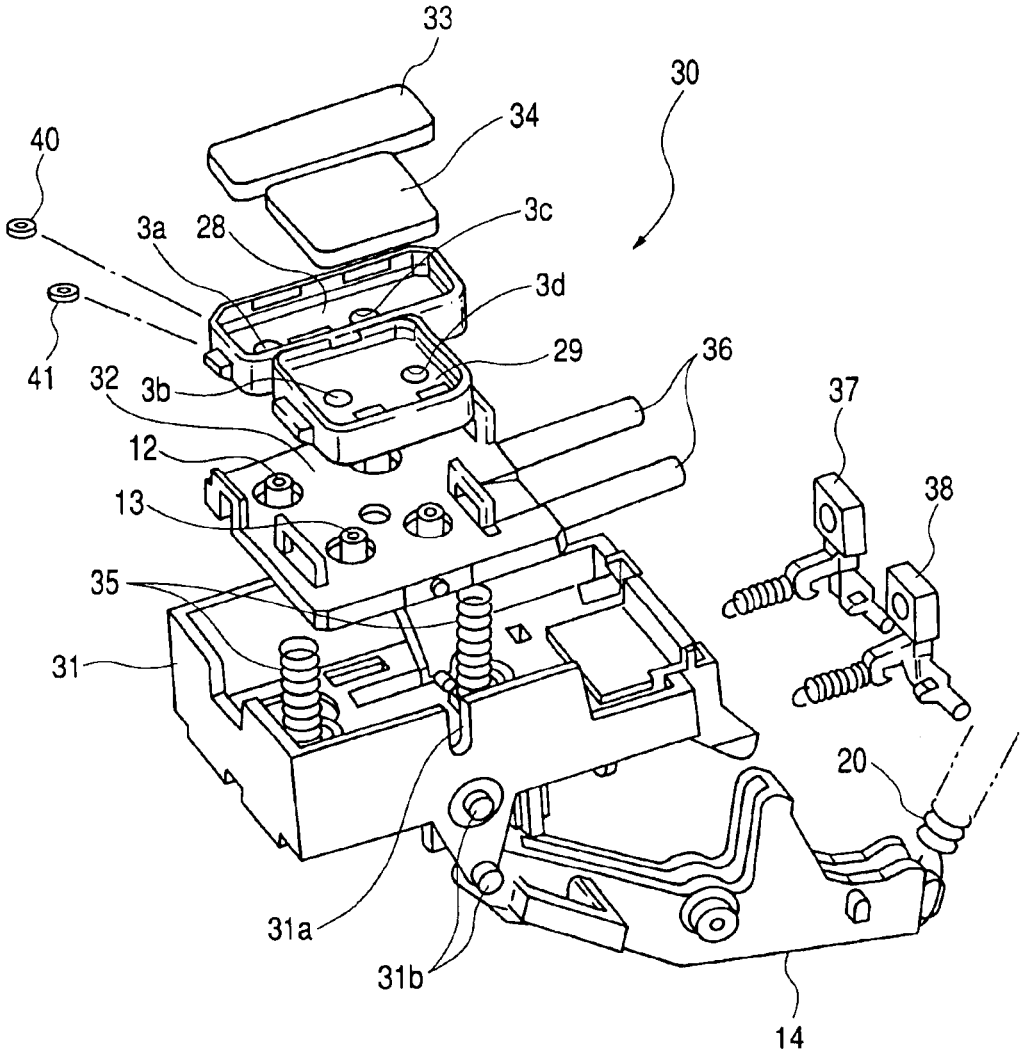
FIG. 3 is a detailed exploded perspective view showing a cap of FIG. 1.
Figure 4:
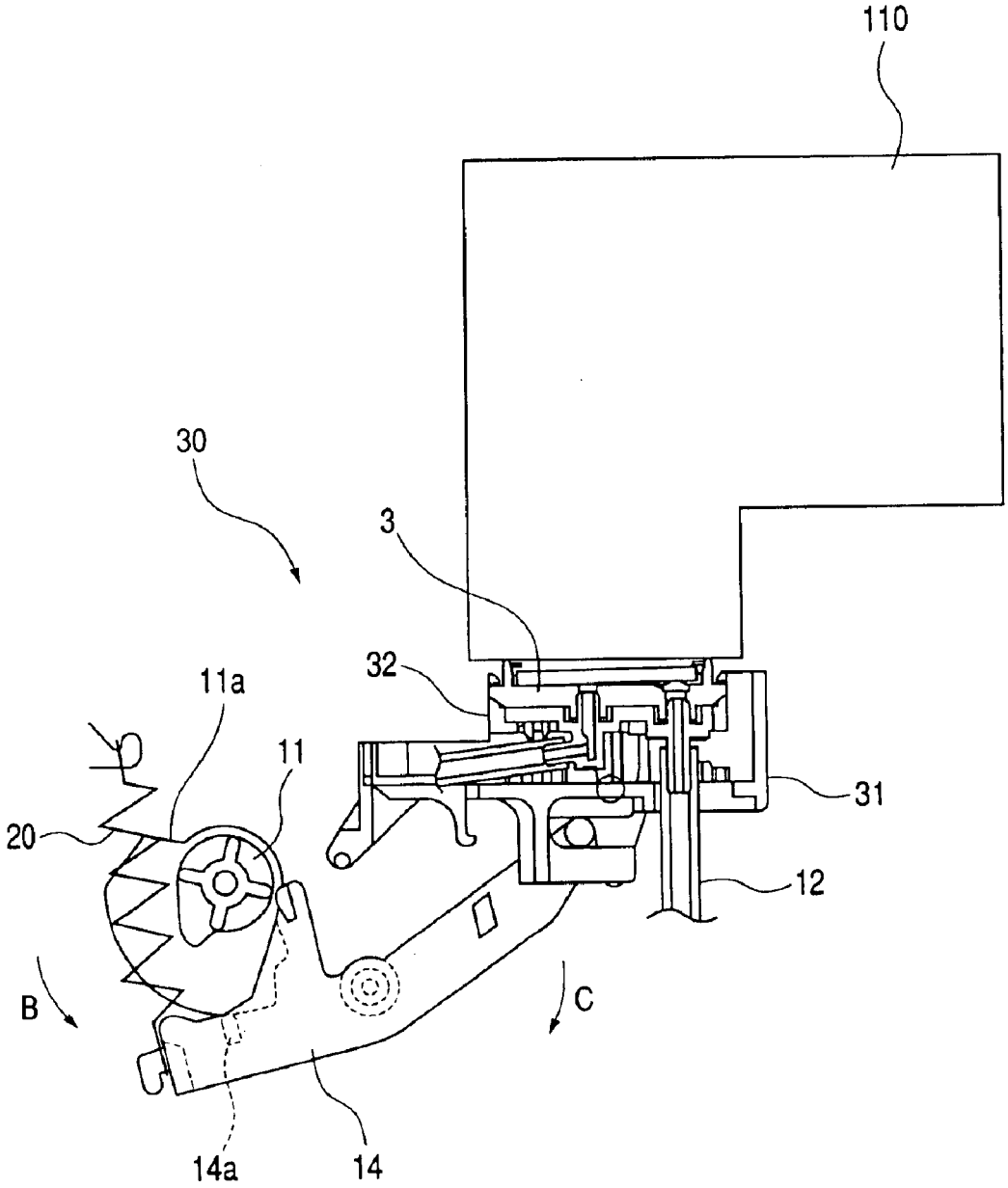
FIG. 4 is a longitudinal sectional view showing a state in which the cap of FIG. 1 hermetically seals the nozzle surface of a recording head.
Figure 5:
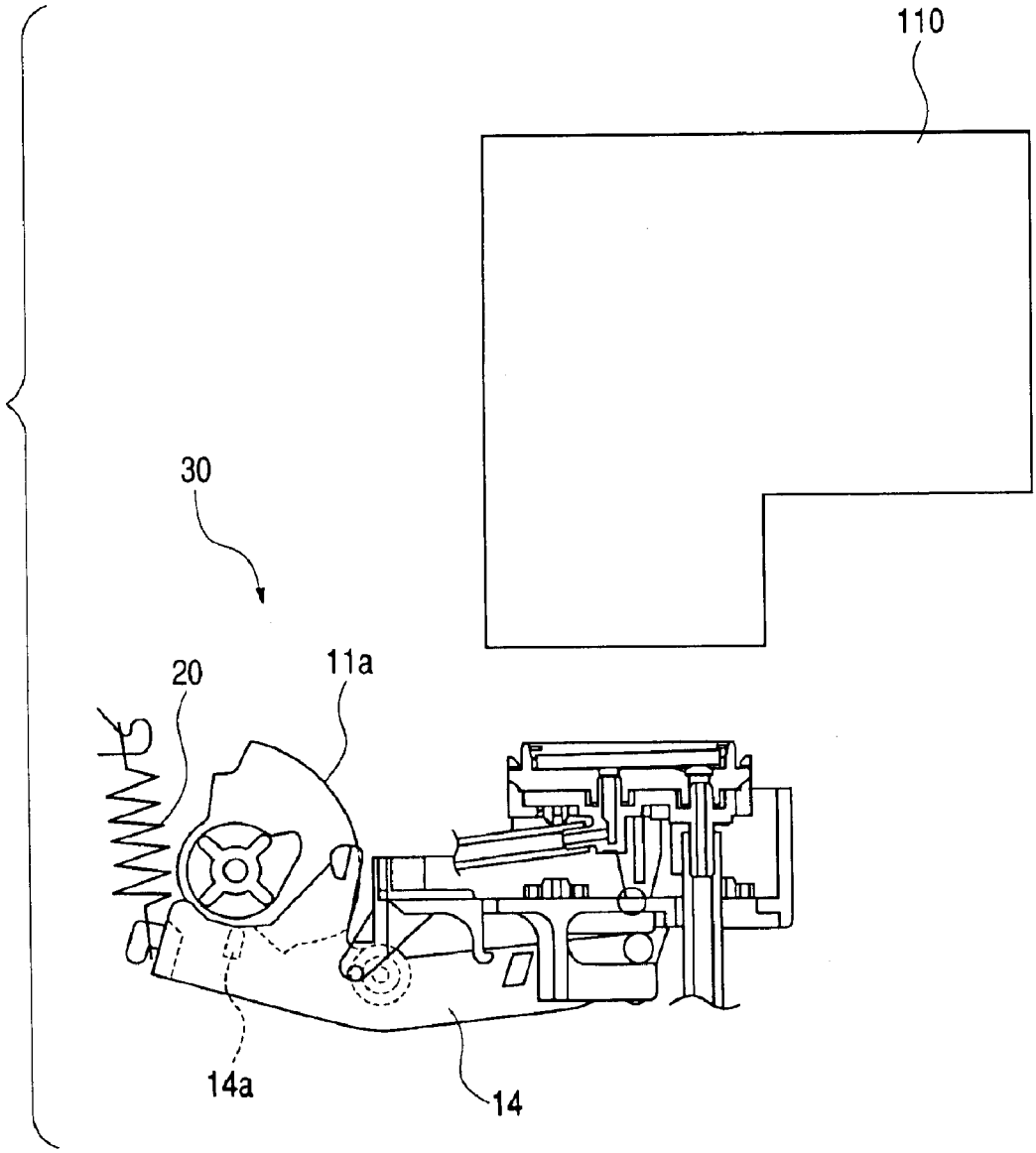
FIG. 5 is a longitudinal sectional view showing a state in which the cap of FIG. 1 releases the nozzle surface of the recording head.
Figure 6:
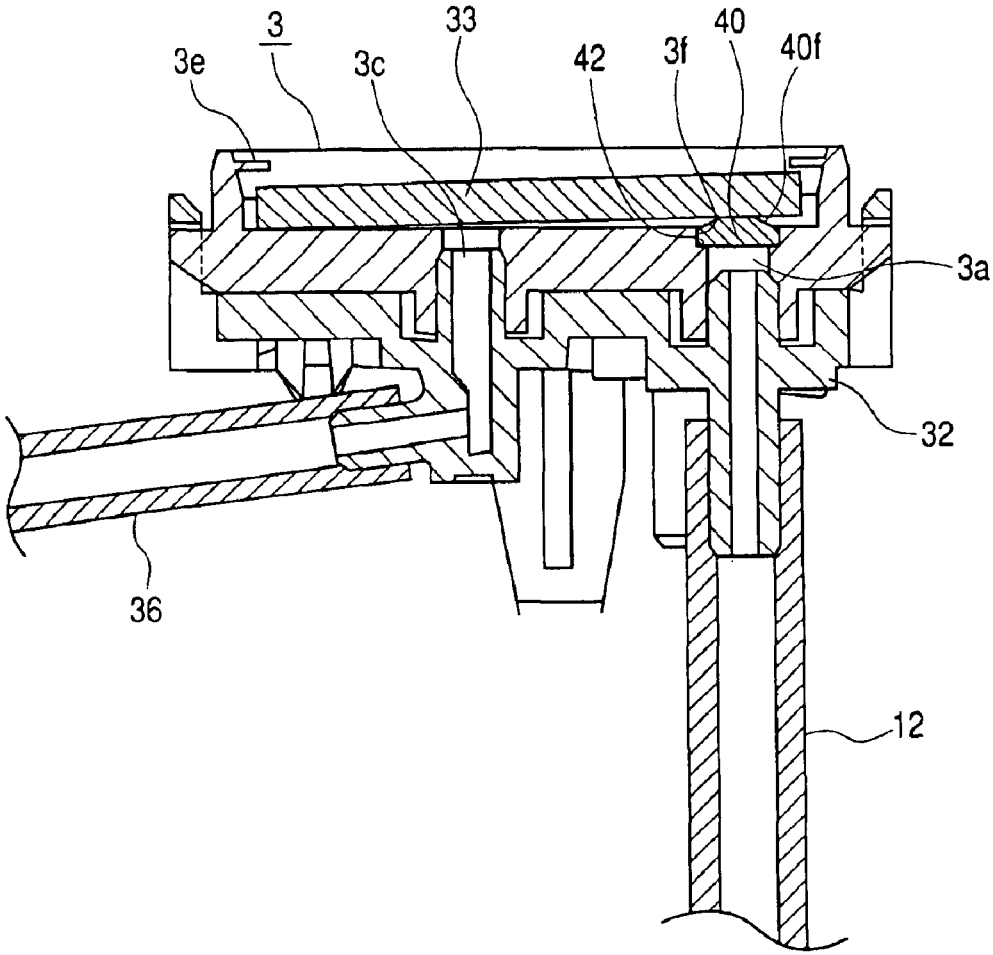
FIG. 6 is a detailed longitudinal sectional view showing the cap in the first embodiment.

Next, the recovery unit 1 in the first embodiment will be described in detail. FIG. 1 is a perspective view showing the recovery unit 1 in the first embodiment; FIG. 2 is an internal perspective view showing an internal structure of the recovery unit of FIG. 2; FIG. 3 is an exploded perspective view showing a cap of FIG. 1 in detail; FIG. 4 is a longitudinal sectional view showing a state in which the cap of FIG. 1 hermetically seals the nozzle surface of the nozzle surface of a recording head; FIG. 5 is a longitudinal sectional view showing a state in which the cap of FIG. 1 releases the nozzle surface of the recording head; and FIG. 6 is a longitudinal sectional view showing the cap in the first embodiment in detail.

In FIG. 1, the recovery unit 1 includes a base 2 for accommodating and holding the cap 3 for capping the nozzle surface 110F of the recording head 110 and other components. Guide grooves 2*a*, which extend in an up/down direction, and guide grooves 2*b*, which extend in a transporting direction of the recording medium, are formed in the base 2. The cap 3 is moved in the up/down direction by being guided by the guide grooves 2*a*. The recovery unit 1 has a blade 4 that reciprocates along the guide grooves 2*b* and wipes the nozzle surface 110F. When the cap 3 caps the nozzle surface 110F, the carriage 104 must be fixed to the guide shaft 105. Accordingly, the recovery unit 1 is provided with a carriage lock 5 for fixing the carriage 104.

The recovery unit 1 includes a motor 6 for driving the cap 3, the blade 4 and the carriage lock 5. The driving force of the motor 6 is transmitted to a main cam 11 through a gear train of gears 7, 8, and 9 and a one-way clutch gear 10 sequentially. Employment of the one-way clutch gear 10 enables only the driving force in one direction of the motor 6 to be transmitted to the main cam 11.

The main cam 11 has a plurality of cams disposed in parallel with each other in the direction of a rotational shaft, the carriage lock 5 is swung by the rotation of a first cam, and the blade 4 is reciprocated in a horizontal direction by the rotation of the second cam. A third cam causes a cap lever 14, which is pivotally mounted on a lower portion of the cap 3, to swing in the up/down direction, thereby the cap 3 is reciprocated in the up/down direction.

Tubes 12 and 13 are connected to the cap 3 and communicate with the inner space of the cap 3. The tubes 12 and 13 are disposed along the inside of an arc-shaped guide surface 2*c* formed in a portion of the base. A roller 17 comes into pressure contact with the tubes 12 and 13 from the insides thereof. A tube pump is composed of the tubes 12 and 13 and the roller 17 which rolls along the guide surface 2*c* in the longitudinal direction of the tubes 12 and 13.

The roller 17 is held by a roller holding means 15 which is disposed concentrically with the arc-shaped guide surface 2*c*, and a pump gear 16, which is driven by the motor 6, is fixed to an end of the roller holding means 15. The pump gear 16 is driven by the motor 6 through the gear 7.

The one-way clutch gear 10 transmits the rotation of the motor 6 only in a direction opposite to the direction of an arrow A (FIG. 2) to the main cam 11 and runs idle with respect to the rotation of the motor 6 in the direction of the arrow A of FIG. 2. When the motor 6 rotates in the direction of the arrow A, the roller 17 rolls while pressing the tubes 12 and 13 so that the tube pump applies suction force to the internal space of the cap 3. With this operation, the ink in the cap 3 is suctioned. Since the one-way clutch gear 10 runs idle at this time, the main cam 11 does not rotate, and the cap 3, the blade 4 and the carriage lock 5 remain stopped. When the motor 6 rotates in the direction opposite to the direction of the arrow A, the cap 3, the blade 4, and the carriage lock 5 operate at predetermined timing, and the tube pump does not execute the suction operation at this time.

In FIG. 3, the cap 3 is assembled in a cap means 30 which includes a cap base 31 for accommodating and holding the cap 3 and other components. A cap holder 32, which holds and fixes the cap 3 and the tubes 12 and 13, is accommodated in the cap base 31, and a guide groove 31*a*, which swingably supports the cap holder 32, is formed in the cap base 31. The internal space of the cap 3 is divided into an absorbing member chamber 28 corresponding to the black ink nozzle 111 and an absorbing member chamber 29 corresponding to the three color ink nozzles 112, 113, and 114. First absorbing portions 33 and 34 each composed of a flat-sheet-like porous member are accommodated in the absorbing member chambers 28 and 29, respectively and cover approximately the entire regions of the absorbing member chambers 28 and 29. The first absorbing portions 33 and 34 suction the ink on the nozzle surface 110F to minimize the ink remaining thereon.

A suction port 3*a* and an atmosphere communication hole 3*c* are opened through the bottom of the absorbing member chamber 28 of the cap 3, and a suction port 3*b* and an atmosphere communication hole 3*d* are opened through the bottom of the absorbing member chamber 29. The tubes 12 and 13 are connected to the suction ports 3*a* and 3*b*, respectively, and tubes 36 are connected to the atmosphere communication holes 3*c* and 3*d* at first ends. When the tube pump executes the suction operation, inks are suctioned from the suction ports 3*a* and 3*b*. When the atmosphere communication holes 3*c* and 3*d* are opened at this time, air is replenished through the atmosphere communication holes 3*c* and 3*d*, thereby the interior of the cap 3 is kept at atmospheric pressure. Therefore, the inks in the cap and in the absorbing members can be discharged without drawing out any ink from the nozzles. When the atmosphere communication holes 3*c* and 3*d* are closed, inks can be suctioned from the nozzles because no atmospheric air is replenished.

Second absorbing portions 40 and 41 are attached in the absorbing member chambers 28 and 29, respectively in intimate contact with the suction ports 3*a* and 3*b*. An absorbing member for the absorbing member chamber 28 is composed of the first and second absorbing portions 33 and 40, and an absorbing member for the absorbing member chamber 29 is composed of the first and second absorbing portions 34 and 41.

Valves 37 and 38 are attached to the other ends of the tubes 36 and can be opened to and closed from atmosphere. The ink in the black ink nozzle and the inks in the color ink nozzles can be independently suctioned by independently opening and closing the valves 37 and 38, and further these nozzles can execute idle suction while being capped after the inks are suctioned therethrough.

A cap spring 35 is interposed between the cap base 31 and the cap holder 32, and the cap 3 is urged toward the nozzle surface 110F by the cap spring 35. With this operation, the abutment pressure of the cap 3 to the nozzle surface 110F is secured in a capping operation, thereby the cap 3 is caused to be securely in intimate contact with the nozzle surface 110F.

Bosses 31*b*, which are engaged with the guide grooves 2*a* of the base 2, are formed on both the sides of the cap base 31 so that the cap base 31 can move up and down along the guide grooves 2*a*. The cap lever 14 is urged by a return spring 20 composed of an extension spring and urges the cap base 31 in a direction where it retracts from the recording head 110.

When the main cam 11 is rotated and the cap lever 14 is displaced by a predetermined cam 11*a* (FIG. 4), the cap means 30 moves upward and the nozzle surface 110F is capped by the cap 3. At this time, although the upward-moving position of the cap base 31 is varied by the tolerance of parts, sufficient capping pressure can be secured because the cap 3 is urged toward the nozzle surface 110F by the cap spring 35. The cap base 31 is pivotally mounted on the cap lever 14 so that the cap 3 can be swung, thereby an equalizing property is applied to the cap means 30. That is, when the recording head 110 inclines, the cap 3 and the cap holder 32 follow the nozzle surface 110F, thereby a reliable capping state can be maintained.

Next, a suction operation and an idle suction operation will be explained. In FIG. 4, the cap lever 14 is engaged with the cam 11*a* of the main cam 11 at an engaging portion 14*a* and moves the cap base 31 to an uppermost position against the return spring 20. At this time, since the cap 3 and the cap holder 32 are caused to be in intimate contact with and abutted against the recording head 110 by the urging force of the cap spring 35, the cap 3 can maintain a good capping state while executing an equalizing operation. When the tube pump is operated in this state, negative pressure can be generated in the absorbing member chambers 28 and 29 of the cap 3. Further, when the idle suction operation is executed, the tube pump is operated by opening the valves 37 and 38 in the capped state. With this operation, the ink staying in the cap 3 can be discharged as well as the ink deposited on the nozzle surface 110F can be exfoliated and removed instantly.

When the main cam 11 rotates in the direction of an arrow B from the state of FIG. 4, the cap lever 14 is rotated by the return spring 20 in the direction of an arrow C along the cam 11*a* and moves the cap base 31 in a downward direction, thereby a state shown in FIG. 5 is achieved. In FIG. 5, the cap 3 is separated from the recording head 110 and moved to a lowermost point.

Next, the arrangements of the absorbing member (the first and second absorbing portions 33 and 40) for the absorbing member chamber 28 and the absorbing member (the first and second absorbing portions 34 and 41) for the absorbing member chamber 29 will be explained in more detail.

In FIG. 6, the second absorbing portion 40 is formed in an approximately cylindrical shape and caused to be in intimate contact with the suction port 3*a* of the absorbing member chamber 28. A counterbore portion 42 is formed in the suction port 3*a* at the opening end thereof on the bottom of the absorbing member chamber 28, and the second absorbing portion 40 is forcibly inserted into the counterbore portion 42 without space left therebetween. The upper side surface of the second absorbing portion 40 is arranged as a taper surface 40*f* whose diameter is reduced upward, and a locking portion 3*f* is formed in the counterbore portion 42. The locking portion 3*f* is engaged with the counterbore portion 42 and prevents the second absorbing portion 40 from being removed upward.

The first absorbing portion 33 is inserted into the absorbing member chamber 28 with a proper gap formed between it and the side wall of the absorbing member chamber 28. A locking portion 3*e* is formed at the upper end of the absorbing member chamber 28 to prevent the first absorbing portion 33 from being removed upward.

Since the size of the second absorbing portion 40 is set such that a portion thereof projects upward from the bottom of the absorbing member chamber 28, the first absorbing portion 33 securely comes into contact with the second absorbing portion 40 by its self weight.

Since the second absorbing portion 40 comes into intimate contact with the suction port 3*a* and the first absorbing portion 33 comes into contact with the second absorbing portion 40, suction force securely acts on the first and second absorbing portions 33 and 40 when the ink is suctioned from suction port 3*a*, thereby defective idle suction can be prevented.

Provision of the second absorbing portion 40 enables the ink in the first absorbing portion 33 to be drawn into the second absorbing portion 40 by capillary action as long as a portion of the second absorbing portion 40 is in contact with the first absorbing portion 33, thereby the ink in the first absorbing portion 33 can be securely discharged when the idle suction is executed. Even if portions in the vicinity of the suction port 3*a* are distorted or even if the first and second absorbing portions 33 and 40 are formed slightly defectively in shape, the intimate contact between the suction port 3*a* and the second absorbing portion 40 is guaranteed.

Accordingly, the first absorbing portion 33 can exert its intrinsic absorbing performance and minimize the ink remaining on the nozzle surface by absorbing the ink on the nozzle surface.

Note that since the first and second absorbing portions 34 and 41 for the absorbing member chamber 29 are arranged similarly to the first and second absorbing portions 33 and 40 for the absorbing member chamber 28, the explanation thereof is omitted.

(Second Embodiment)

Next, a second embodiment of the ink jet recording apparatus according to the present invention will be described based on figures in detail. Note that the components similar or corresponding to those in the first embodiment are denoted by the same reference numerals, and the explanation thereof is omitted.

Figure 7:
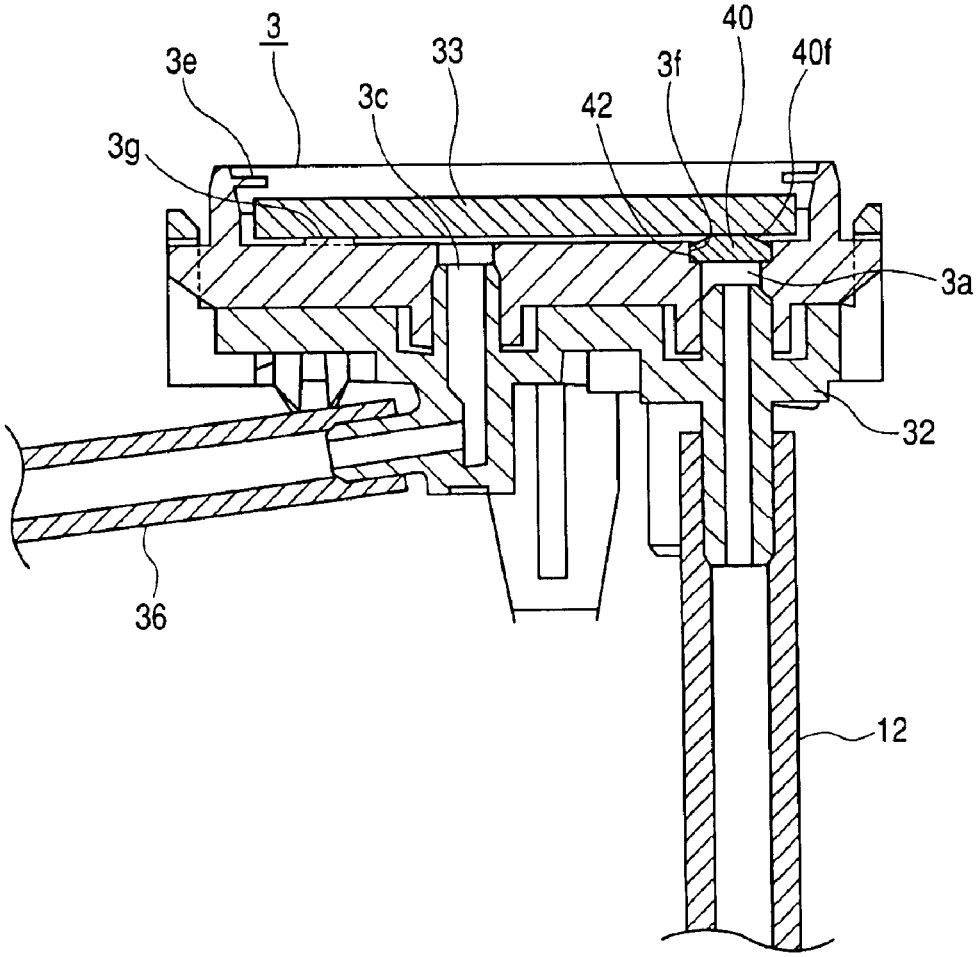
FIG. 7 is a detailed longitudinal sectional view of a cap in a second embodiment.

FIG. 7 is a detailed longitudinal sectional view showing a cap in a recovery unit of the second embodiment. Although the second absorbing portion 40 is caused to come into contact with the first absorbing portion 33 by partly projecting from the bottom of the absorbing member chamber 28 in the first embodiment, the first absorbing portion 33 placed on the second absorbing portion 40 is inclined. With this arrangement, since the distance between the nozzle surface 110F and the first absorbing portion 33 is made uneven, an amount of ink remaining on the nozzle surface may be different depending upon a position of the surface. The second embodiment intends to overcome this drawback by a simple arrangement.

In FIG. 7, a projection 3*g* is formed on the bottom of an absorbing member chamber 28 at a position apart from a suction port 3*a*, and a first absorbing portion 33 is placed on a second absorbing portion 40 and on the projection 3*g* and supported thereby approximately in parallel with the bottom of the absorbing member chamber 28. With this arrangement, since the distance between a nozzle surface 110F and the first absorbing portion 33 is made uniform, a uniform amount of ink remains on the nozzle surface.

Although a gap is formed over the entire region between the first absorbing portion 33 and the bottom of the absorbing member chamber 28, a problem of defective idle suction does not arise as long as the second absorbing portion 40 is in intimate contact with the suction port 3*a*.

Note that since first and second absorbing portions 34 and 41 for an absorbing member chamber 29 are arranged similarly to the first and second absorbing portions 33 and 40 for the absorbing member chamber 28, the explanation thereof is omitted.

(Third Embodiment)

Next, a third embodiment of the ink jet recording apparatus according to the present invention will be explained based on figures in detail. Note that the components similar or corresponding to those in the first embodiment are denoted by the same reference numerals, and the explanation thereof is omitted.

Figure 8:
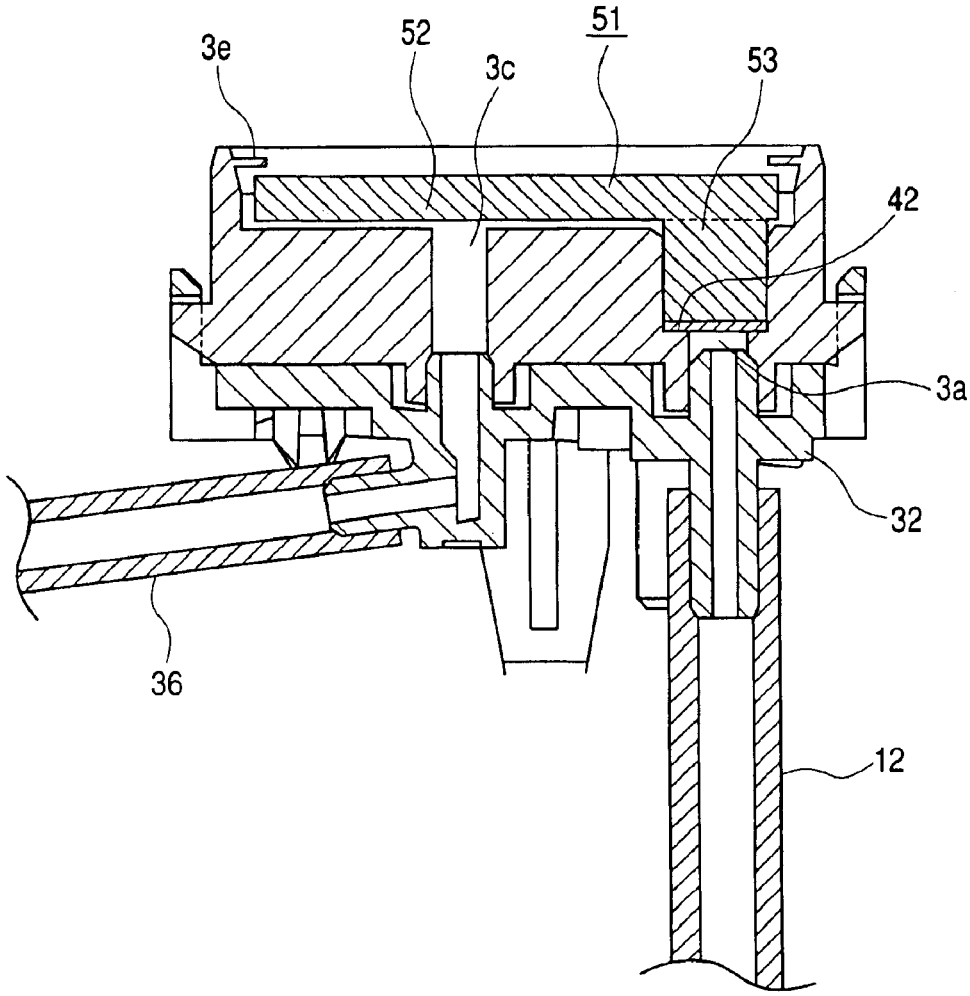
FIG. 8 is a detailed longitudinal sectional view of a cap in a third embodiment.

FIG. 8 is a detailed longitudinal sectional view showing a cap in a recovery unit of the third embodiment. In the third embodiment, absorbing members are formed integrally as a one-piece absorbing member.

In FIG. 8, the one-piece absorbing member 51 is accommodated in an absorbing member chamber 28, and the absorbing member 51 is composed of a first absorbing portion 52 and a second absorbing portion 53. The second absorbing portion 53 projects downward from the bottom of the first absorbing portion 52 and forcibly inserted into the counterbore portion 42 of a suction port 3*a* in intimate contact therewith. Since the absorbing member 51 is arranged as the one-piece member, the number of parts and the number of assembling steps can be reduced as well as the ink in the absorbing member 51 can be securely discharged when idle suction is executed.

Since the cap 3 is composed of a rubber member, the counterbore portion 42 is expanded by the pressure applied thereto when the second absorbing portion 53 is inserted, thereby the second absorbing portion 53 is compressed. Force for pushing out the second absorbing portion 53 upward is applied thereto by the compression force. Thus, the counterbore portion 42 of the third embodiment is formed longer than those of the first and second embodiments so that the friction force of the inner surface thereof is increased.

Note that since first and second absorbing portions for an absorbing member chamber 29 are arranged similarly to the first and second absorbing portions 52 and 53 for the absorbing member chamber 28, the explanation thereof is omitted.

It should be noted that the above embodiments have been explained as to a serial type ink jet recording apparatus for executing recording while moving the recording head acting as a recording means in a main scan direction. However, the present invention can be also applied to a line type ink jet recording apparatus likewise, which executes recording only by sub-scan using a line type ink jet head that entirely or partly covers the width of a recording medium, and the present invention can achieve a similar effect.

Further, the present invention can be freely embodied regardless of the number of the recording heads and can be applied to a color ink jet recording apparatus employing a plurality of recording heads each using a different color ink, to a gradation ink jet recording apparatus employing a plurality of recording heads each using an ink having the same color and a different density, and further to an ink jet recording apparatus arranged by combining the above ink jet recording apparatuses, in addition to an ink jet recording apparatus employing a single recording head, and the present invention can achieve the same effect.

Further, the present invention can be applied likewise to cases in which a recording head and an ink tank are arranged in any variety and disposed in any manner, i.e., to a case in which an exchangeable head cartridge composed of a recording head integrated with an ink tank is used and to a case in which a recording head is arranged separately from an ink tank and they are connected to each other through an ink supply tube and the like, and the present invention can achieve the same effect.

Note that although the present invention can be also applied to an ink jet recording apparatus employing an ink jet recording head using an electromechanical transducer, for example, a piezo element and the like, the present invention exerts an excellent effect particularly in an ink jet recording apparatus employing an ink jet recording head using a system for ejecting ink making use of thermal energy. This is because the system can achieve very fine recording (print) with high density.

What is claimed is:

1. An ink jet recording apparatus for executing recording by ejecting ink from recording means to a recording medium, comprising:

a cap movable in directions where it comes into contact with and is separated from an ejection port surface of the recording means, for capping the ejection port surface;

an absorbing member chamber disposed in the cap and opened in confrontation with the ejection port surface;

a suction port formed through a bottom of the absorbing member chamber;

suction means, connected to the suction port, for suctioning the ink in the absorbing member chamber; and an absorbing member disposed in the absorbing member chamber for absorbing ink, said absorbing member comprising a first absorbing portion covering approximately an entire region in the absorbing member chamber and a second absorbing portion in intimate contact with the suction port, wherein the first absorbing portion is arranged separately from the second absorbing portion, and the second absorbing portion projects through the bottom of the absorbing member chamber and comes into contact with the bottom of the first absorbing portion.

2. An ink jet recording apparatus according to claim 1, wherein the absorbing member chamber has a projection formed on the bottom thereof at a position apart from the suction port, and the first absorbing portion is supported by the second absorbing portion and the projection.

3. An ink jet recording apparatus according to claim 1, wherein the absorbing member chamber has a locking portion for preventing the first absorbing portion from being removed.

4. An ink jet recording apparatus for executing recording by ejecting ink from recording means to a recording medium, comprising:

a cap movable in directions where it comes into contact with and is separated from an ejection port surface of the recording means, for capping the ejection port surface;

an absorbing member chamber disposed in the cap and opened in confrontation with the ejection port surface;

a suction port formed through a bottom of the absorbing member chamber;

suction means, connected to the suction port, for suctioning the ink in the absorbing member chamber; and an absorbing member disposed in the absorbing member chamber for absorbing ink, said absorbing member comprising a first absorbing portion covering approximately an entire region in the absorbing member chamber and a second absorbing portion in intimate contact with the suction port, wherein a counterbore portion into which the second absorbing portion is forcibly inserted is formed in the suction port at an opening end thereof on the bottom of the absorbing member chamber.

5. An ink jet recording apparatus according to claim 4, wherein the first absorbing portion is formed integrally with the second absorbing portion.

6. An ink jet recording apparatus according to claim 4, wherein the counterbore portion has a locking portion for preventing the second absorbing portion from being removed.

* * * * *